US006029943A

United States Patent [19]

Sievert

[11] Patent Number: 6,029,943

[45] Date of Patent: Feb. 29, 2000

[54] SPLITTING TECHNIQUE

[75] Inventor: Dick J. Sievert, *deceased, late of* New Richmond, Wis., *by* Sandra E. Sievert, *heir*

[73] Assignee: Anchor Wall Systems, Inc., Minnetonka, Minn.

[21] Appl. No.: 08/807,264

[22] Filed: Feb. 28, 1997

Related U.S. Application Data

[63] Continuation-in-part of application No. 08/774,247, Nov. 8, 1996.

[51] Int. Cl.[7] ..... B28B 7/14

[52] U.S. Cl. ..... 249/52; 249/117; 425/412; 425/422

[58] Field of Search ..... 249/52, 117, 119; 425/346, 351, 412, 413, 422, 443, 444

[56] References Cited

U.S. PATENT DOCUMENTS

| | | |
|---|---|---|
| Re. 34,314 | 7/1993 | Forsberg . |
| 126,547 | 8/1872 | Hickcox . |
| 228,052 | 5/1880 | Frost . |
| D. 237,704 | 11/1975 | Lane . |
| D. 279,030 | 5/1985 | Risi et al. . |
| D. 280,024 | 8/1985 | Risi et al. . |
| D. 284,109 | 6/1986 | Seal, Jr. . |
| D. 295,788 | 5/1988 | Forsberg . |
| D. 295,790 | 5/1988 | Forsberg . |
| D. 296,007 | 5/1988 | Forsberg . |
| D. 296,365 | 6/1988 | Forsberg . |
| D. 297,464 | 8/1988 | Forsberg . |
| D. 297,574 | 9/1988 | Forsberg . |
| D. 297,767 | 9/1988 | Forsberg . |
| D. 298,463 | 11/1988 | Forsberg . |
| D. 299,067 | 12/1988 | Forsberg . |
| D. 299,069 | 12/1988 | Risi et al. . |
| D. 300,253 | 3/1989 | Forsberg . |
| D. 300,254 | 3/1989 | Forsberg . |
| D. 301,064 | 5/1989 | Forsberg . |
| D. 311,444 | 10/1990 | Forsberg . |

(List continued on next page.)

FOREIGN PATENT DOCUMENTS

| | | |
|---|---|---|
| 2744/26 | 7/1927 | Australia . |
| 22397/83 | 6/1985 | Australia . |
| 548 462 | 12/1985 | Australia . |
| 67477/81 | 12/1985 | Australia . |
| 52765/86 | 8/1986 | Australia . |
| 80775/87 | 4/1988 | Australia . |
| 528788 | 5/1954 | Belgium . |
| 338139 | 12/1933 | Canada . |
| 531354 | 10/1958 | Canada . |
| 941626 | 2/1974 | Canada . |
| 1040452 | 10/1978 | Canada . |
| 1065154 | 10/1979 | Canada . |
| D. 47747 | 1/1981 | Canada . |
| D. 50020 | 7/1982 | Canada . |
| D. 51160 | 4/1983 | Canada . |
| D. 51313 | 5/1983 | Canada . |
| D. 51794 | 9/1983 | Canada . |
| 1182295 | 2/1985 | Canada . |
| 1188116 | 6/1985 | Canada . |
| 1194703 | 10/1985 | Canada . |
| 1197391 | 12/1985 | Canada . |
| 1204296 | 5/1986 | Canada . |
| D. 62875 | 4/1989 | Canada . |
| D. 63365 | 5/1989 | Canada . |
| D. 63366 | 5/1989 | Canada . |

OTHER PUBLICATIONS

Besser, Technical Data for the Blockmaker, Besser Research and Training Center, pp. 33 and 34 (1962).

Besser, Concrete Paving Stones, Manual No. 8601—Section 5, Besser Company, pp. 1–24 (Undated).

Besser, Parts and Equipment, Besser Company, pp. 1–80 (before 1990).

(List continued on next page.)

*Primary Examiner*—James P. Mackey
*Attorney, Agent, or Firm*—Merchant & Gould P.C.

[57] ABSTRACT

A concrete masonry unit having a top surface with a splitting pattern formed therein. The splitting pattern has a splitting groove which intersects at least one recessed region formed in the top surface.

10 Claims, 8 Drawing Sheets

U.S. PATENT DOCUMENTS

| | | |
|---|---|---|
| D. 316,904 | 5/1991 | Forsberg . |
| D. 317,048 | 5/1991 | Forsberg . |
| D. 317,209 | 5/1991 | Forsberg . |
| 468,838 | 2/1892 | Steiger . |
| 566,924 | 9/1896 | Morrin . |
| 810,748 | 1/1906 | Haller et al. . |
| 831,077 | 9/1906 | Johnson . |
| 847,476 | 3/1907 | Hodges . |
| 884,354 | 4/1908 | Bertrand . |
| 916,756 | 3/1909 | Grant . |
| 1,002,161 | 8/1911 | Lambert . |
| 1,092,621 | 4/1914 | Worner . |
| 1,219,127 | 3/1917 | Marshall . |
| 1,222,061 | 4/1917 | Bartells . |
| 1,248,070 | 11/1917 | Buente . |
| 1,285,458 | 11/1918 | Strunk . |
| 1,287,055 | 12/1918 | Lehman . |
| 1,330,884 | 2/1920 | McDermott . |
| 1,414,444 | 5/1922 | Straight . |
| 1,419,805 | 6/1922 | Bigler . |
| 1,456,498 | 5/1923 | Binns . |
| 1,465,608 | 8/1923 | McCoy . |
| 1,472,917 | 11/1923 | Laird . |
| 1,534,353 | 4/1925 | Besser . |
| 1,557,946 | 10/1925 | Smith . |
| 1,685,997 | 12/1928 | Evers et al. . |
| 1,727,363 | 9/1929 | Bone . |
| 1,733,790 | 10/1929 | Gilman . |
| 1,751,028 | 3/1930 | Caswell et al. . |
| 1,773,579 | 8/1930 | Flath . |
| 1,872,522 | 8/1932 | Stuckey . |
| 1,907,053 | 5/1933 | Flath . |
| 1,993,291 | 5/1935 | Vermont . |
| 2,011,531 | 8/1935 | Tranchell . |
| 2,034,851 | 3/1936 | Wichmann . |
| 2,094,167 | 9/1937 | Evers . |
| 2,113,076 | 4/1938 | Bruce . |
| 2,121,450 | 6/1938 | Sentrop . |
| 2,149,957 | 3/1939 | Dawson . |
| 2,197,960 | 4/1940 | Alexander . |
| 2,219,606 | 10/1940 | Schoick . |
| 2,235,646 | 3/1941 | Schaffer . |
| 2,313,363 | 3/1943 | Schmitt . |
| 2,371,201 | 3/1945 | Wells . |
| 2,570,384 | 10/1951 | Russell . |
| 2,593,606 | 4/1952 | Price . |
| 2,683,916 | 7/1954 | Kelly . |
| 2,881,753 | 4/1959 | Entz . |
| 2,882,689 | 4/1959 | Huch et al. . |
| 2,892,340 | 6/1959 | Fort . |
| 2,925,080 | 2/1960 | Smith . |
| 2,963,828 | 12/1960 | Belliveau . |
| 3,036,407 | 5/1962 | Dixon . |
| 3,185,432 | 5/1965 | Hager, Jr. . |
| 3,204,316 | 9/1965 | Jackson . |
| 3,274,742 | 9/1966 | Paul, Jr. et al. . |
| 3,378,885 | 4/1968 | Dart . |
| 3,386,503 | 6/1968 | Corning et al. . |
| 3,390,502 | 7/1968 | Carroll . |
| 3,391,719 | 7/1968 | Clanton et al. . |
| 3,430,404 | 3/1969 | Muse . |
| 3,488,964 | 1/1970 | Kubo . |
| 3,557,505 | 1/1971 | Kaul . |
| 3,631,682 | 1/1972 | Hilfiker et al. . |
| 3,659,077 | 4/1972 | Olson . |
| 3,667,186 | 6/1972 | Kato . |
| 3,754,499 | 8/1973 | Heisman et al. . |
| 3,783,566 | 1/1974 | Nielson . |
| 3,888,060 | 6/1975 | Haener . |
| 3,925,994 | 12/1975 | Broms et al. . |
| 3,932,098 | 1/1976 | Huber et al. . |
| 3,936,987 | 2/1976 | Calvin . |
| 3,936,989 | 2/1976 | Hancock . |
| 3,953,979 | 5/1976 | Kurose . |
| 3,981,038 | 9/1976 | Vidal . |
| 3,995,434 | 12/1976 | Kato et al. . |
| 3,996,389 | 12/1976 | Osborne . |
| 4,001,988 | 1/1977 | Riefler . |
| 4,016,693 | 4/1977 | Warren . |
| 4,023,767 | 5/1977 | Fontana . |
| 4,051,570 | 10/1977 | Hilfiker . |
| 4,067,166 | 1/1978 | Sheahan . |
| 4,083,190 | 4/1978 | Pey . |
| 4,098,040 | 7/1978 | Riefler . |
| 4,098,865 | 7/1978 | Repasky . |
| 4,107,894 | 8/1978 | Mullins . |
| 4,110,949 | 9/1978 | Cambiuzzi et al. . |
| 4,114,773 | 9/1978 | Sekiguchi . |
| 4,124,961 | 11/1978 | Habegger . |
| 4,126,979 | 11/1978 | Hancock . |
| 4,132,492 | 1/1979 | Jenkins . |
| 4,145,454 | 3/1979 | Dea et al. . |
| 4,175,888 | 11/1979 | Ijima . |
| 4,186,540 | 2/1980 | Mullins . |
| 4,187,069 | 2/1980 | Mullins . |
| 4,190,384 | 2/1980 | Neumann . |
| 4,193,718 | 3/1980 | Wahrendorf et al. . |
| 4,207,718 | 6/1980 | Schaaf et al. . |
| 4,208,850 | 6/1980 | Collier . |
| 4,214,655 | 7/1980 | Bernham et al. . |
| 4,218,206 | 8/1980 | Mullins . |
| 4,228,628 | 10/1980 | Schlomann . |
| 4,229,123 | 10/1980 | Heinzmann . |
| 4,238,105 | 12/1980 | West . |
| 4,242,299 | 12/1980 | Adams . |
| 4,250,863 | 2/1981 | Gagnon et al. . |
| 4,262,463 | 4/1981 | Hapel . |
| 4,288,960 | 9/1981 | Auras . |
| 4,312,606 | 1/1982 | Sarikelle . |
| 4,314,431 | 2/1982 | Rabassa . |
| 4,319,440 | 3/1982 | Rassias et al. . |
| 4,324,505 | 4/1982 | Hammett . |
| 4,335,549 | 6/1982 | Dean, Jr. . |
| 4,337,605 | 7/1982 | Tudek . |
| 4,372,091 | 2/1983 | Brown et al. . |
| 4,380,091 | 4/1983 | Lively . |
| 4,380,409 | 4/1983 | O'Neill . |
| 4,384,810 | 5/1983 | Neumann . |
| 4,426,176 | 1/1984 | Terada . |
| 4,426,815 | 1/1984 | Brown . |
| 4,449,857 | 5/1984 | Davis . |
| 4,454,699 | 6/1984 | Strobl . |
| 4,470,728 | 9/1984 | Broadbent . |
| 4,490,075 | 12/1984 | Risi et al. . |
| 4,496,266 | 1/1985 | Ruckstuhl . |
| 4,512,685 | 4/1985 | Hegle . |
| 4,524,551 | 6/1985 | Scheiwiller . |
| 4,572,699 | 2/1986 | Rinninger . |
| 4,616,959 | 10/1986 | Hilfiker . |
| 4,640,071 | 2/1987 | Haener . |
| 4,651,485 | 3/1987 | Osborne . |
| 4,658,541 | 4/1987 | Haile . |
| 4,659,304 | 4/1987 | Day . |
| 4,660,342 | 4/1987 | Salisbury . |
| 4,661,023 | 4/1987 | Hilfiker . |
| 4,671,706 | 6/1987 | Giardini . |
| 4,684,294 | 8/1987 | O'Neill . |
| 4,698,949 | 10/1987 | Dietrich . |
| 4,711,606 | 12/1987 | Leling et al. . |
| 4,721,847 | 1/1988 | Leverenz . |
| 4,726,567 | 2/1988 | Greensberg . |

| | | | |
|---|---|---|---|
| 4,728,227 | 3/1988 | Wilson et al. . | |
| 4,738,059 | 4/1988 | Dean, Jr. . | |
| 4,745,720 | 5/1988 | Taylor . | |
| 4,770,218 | 9/1988 | Duerr . | |
| 4,784,821 | 11/1988 | Leopold . | |
| 4,802,320 | 2/1989 | Forsberg . | |
| 4,802,836 | 2/1989 | Whissell . | |
| 4,815,897 | 3/1989 | Risi et al. . | |
| 4,824,293 | 4/1989 | Brown et al. . | |
| 4,825,619 | 5/1989 | Forsberg . | |
| 4,860,505 | 8/1989 | Bender . | |
| 4,884,921 | 12/1989 | Smith . | |
| 4,896,472 | 1/1990 | Hunt . | |
| 4,896,999 | 1/1990 | Ruckstuhl . | |
| 4,909,010 | 3/1990 | Gravier . | |
| 4,909,717 | 3/1990 | Pardo . | |
| 4,914,876 | 4/1990 | Forsberg . | |
| 4,936,712 | 6/1990 | Glickman . | |
| 4,964,761 | 10/1990 | Rossi . | |
| 4,965,979 | 10/1990 | Larrivee et al. . | |
| 4,990,032 | 2/1991 | Smith . | |
| 5,017,049 | 5/1991 | Sievert . | |
| 5,031,376 | 7/1991 | Bender et al. . | |
| 5,044,834 | 9/1991 | Janopaul, Jr. . | |
| 5,062,610 | 11/1991 | Woolford et al. . | |
| 5,104,594 | 4/1992 | Hillemeier et al. . | |
| 5,125,815 | 6/1992 | Kargarzadeh et al. . | |
| 5,139,721 | 8/1992 | Castonguay et al. . | |
| 5,158,132 | 10/1992 | Guillemot . | |
| 5,161,918 | 11/1992 | Hodel . | |
| 5,249,950 | 10/1993 | Woolford . | |
| 5,261,806 | 11/1993 | Pleasant . | |
| 5,294,216 | 3/1994 | Sievert . | |
| 5,337,527 | 8/1994 | Wagenaar . | |
| 5,353,569 | 10/1994 | Rodrique . | |
| 5,421,034 | 6/1995 | Keune . | |
| 5,421,135 | 6/1995 | Stevens et al. . | |
| 5,484,236 | 1/1996 | Gravier . | |
| 5,490,363 | 2/1996 | Woolford . | |
| 5,505,034 | 4/1996 | Dueck . | |
| 5,589,124 | 12/1996 | Woolford et al. ..... | 264/157 |
| 5,598,679 | 2/1997 | Orton et al. . | |
| 5,622,456 | 4/1997 | Risi et al. . | |
| 5,653,558 | 8/1997 | Price . | |
| 5,688,079 | 11/1997 | Bolduc et al. . | |
| 5,704,183 | 1/1998 | Woolford . | |

FOREIGN PATENT DOCUMENTS

| | | |
|---|---|---|
| D. 65896 | 4/1990 | Canada . |
| D. 66760 | 8/1990 | Canada . |
| D. 67904 | 1/1991 | Canada . |
| 2012286 | 9/1991 | Canada . |
| D. 58648 | 5/1997 | Canada . |
| D. 58649 | 5/1997 | Canada . |
| 0 039 372 | 11/1981 | European Pat. Off. . |
| 0 130 921 | 1/1985 | European Pat. Off. . |
| 0 170 113 | 7/1985 | European Pat. Off. . |
| 0 215 991 | 9/1985 | European Pat. Off. . |
| 0 322 668 | 12/1988 | European Pat. Off. . |
| 0 362 110 | 4/1990 | European Pat. Off. . |
| 0 490 534 | 6/1992 | European Pat. Off. . |
| 0 649 714 | 4/1995 | European Pat. Off. . |
| 392 474 | 11/1908 | France . |
| 1 360 872 | 4/1963 | France . |
| 2 228 900 | 5/1974 | France . |
| 2 243 304 | 9/1974 | France . |
| 2 343 871 | 5/1976 | France . |
| 2 422 780 | 12/1978 | France . |
| 2 409 351 | 6/1979 | France . |
| 2 463 237 | 8/1979 | France . |
| 2 465 032 | 9/1979 | France . |
| 2 476 179 | 8/1981 | France . |
| 2561684 | 9/1985 | France . |
| 2 622 227 | 12/1989 | France . |
| 2 675 835 | 10/1992 | France . |
| 22 59 654 | 6/1974 | Germany . |
| 18 11 932 | 6/1978 | Germany . |
| 27 55 833 | 7/1978 | Germany . |
| 27 19 107 | 11/1978 | Germany . |
| 28 41 001 | 4/1980 | Germany . |
| 34 01 629 | 7/1984 | Germany . |
| 90 15 196 | 4/1991 | Germany . |
| 296 10 306 | 8/1996 | Germany . |
| 341611 | 8/1936 | Italy . |
| 456776 | 4/1950 | Italy . |
| 4599442 | 10/1950 | Italy . |
| 0709599 | 6/1966 | Italy . |
| 92167 | 7/1948 | New Zealand . |
| 127514 | 10/1961 | New Zealand . |
| 151299 | 4/1969 | New Zealand . |
| 152194 | 4/1969 | New Zealand . |
| 158045 | 2/1972 | New Zealand . |
| 218830 | 9/1989 | New Zealand . |
| 215196 | 12/1989 | New Zealand . |
| D. 24781 | 5/1993 | New Zealand . |
| D. 25131 | 6/1994 | New Zealand . |
| D. 25132 | 6/1994 | New Zealand . |
| D. 25133 | 6/1994 | New Zealand . |
| D. 27313 | 6/1996 | New Zealand . |
| D. 27314 | 6/1996 | New Zealand . |
| D. 27315 | 6/1996 | New Zealand . |
| D. 27316 | 6/1996 | New Zealand . |
| D. 27317 | 6/1996 | New Zealand . |
| D. 27318 | 6/1996 | New Zealand . |
| D. 27346 | 9/1996 | New Zealand . |
| D. 27675 | 9/1996 | New Zealand . |
| D. 27676 | 9/1996 | New Zealand . |
| D. 27677 | 9/1996 | New Zealand . |
| 205452 | 9/1939 | Switzerland . |
| 657 172 | 8/1986 | Switzerland . |
| 669 001 | 2/1989 | Switzerland . |
| 678160 | 12/1977 | U.S.S.R. . |
| 1145106 | 3/1985 | U.S.S.R. . |
| 1500005 | 12/1986 | U.S.S.R. . |
| 336 | 2/1871 | United Kingdom . |
| 107 338 | 7/1917 | United Kingdom . |
| 248234 | 3/1926 | United Kingdom . |
| 420677 | 12/1934 | United Kingdom . |
| 536434 | 12/1940 | United Kingdom . |
| 537153 | 6/1941 | United Kingdom . |
| 944066 | 12/1963 | United Kingdom . |
| 970 595 | 9/1964 | United Kingdom . |
| 1 385 207 | 1/1975 | United Kingdom . |
| 1 386 088 | 3/1975 | United Kingdom . |
| 1 477 139 | 6/1977 | United Kingdom . |
| 2 091 775 | 8/1982 | United Kingdom . |
| 2 127 872 | 4/1984 | United Kingdom . |
| 2 213 095 | 8/1989 | United Kingdom . |

OTHER PUBLICATIONS

Besser Accessories Catalog (1984).

Block Systems, Inc., "Aztech Installation Guide" (date unknown).

Block Systems, Inc., "Aztech Tech Spec™", Nov. 1989.

Bulletin 7062, Jul. 1, 1994.

Columbia Machine Mold Descriptions (date unknown).

Creative Alternatives, Block Systems Incorporated, Concrete Ideas (1989).

*Diamond Block* Test Report to University of Wisconsin, Platteville (1990).

Diamond Wall System Installation Guide, Diamond Wall System, Block Systems, Inc. (1989).

*Diamond Wall Systems: The Cutting Edge,* Anchor Block Co. (date unknown).
*EZ Wall Systems* Product Literature, Rockwood Retaining Wall Systems, Inc. (date unknown).
*Garden Wall* Product Literature (1991).
*Handy–Stone Retaining Wall System* Product Literature (date unknown).
Installation & Design Manual, Rockwood Classic, The one–piece easy to use system, Rockwood Retaining Walls, Inc. (Undated).
*Johnson Block* Product Literature (date unknown).
Kawano Cement Brochure (date unknown).
*Keystone International Compac Unit* Product Literature (1992).
*Keystone Retaining Wall Systems* Product Literature (1992).
Krehling Industries article, *Florida block and r/m plant relies on admixtures* (Undated).
*Modular Concrete Block,* the Besser Co. (date unknown).
Orco Block Co., *Split Face Block* Product Literature (date unknown).
*Paving Stone: New Lock With Old World Charm,* the Besser Co. (date unknown).
PISA II, Interlocking Retaining Wall System, Interlock Paving Company, (1988).
Profile HEX Masonry Units literature (Undated).
A Review of Paver Production on Besser Block Machines, Lucas E. Pfeiffenberger, pp. 33–37, (1984) (2 parts).
Single–element retaining wall system is ideal for block producers, Robert L. Hubler, Jr., Sep., 1983.
Various Diamond Wall System 4 and 4.4 Concrete Masonry Units Tech Spec's, Anchor Block (1988, 1989).
*Versa Lock* Product Literature (date unknown).
*Windsor Stone* Product Literature, Block Systems, Inc. (1991).
Allan Block™ advertisement, *Landscape Architecture,* Apr. 1989 (2 pages).
Allan Block™ advertisement, *Landscape Architecture,* Dec. 1989 (3 pages).
Allan Block, Inc.—"New Mortarless Block Retaining Wall System" (New product announcement in *Concrete Products,* Mar. 1989, 92(3).
Anchor Wall Systems—16 photographs (Undated).
Besser (Qld.) Limited—Terrace Block (Brochure, 2 pages); date unknown.
Besser Tasmania Pty. Ltd—Besser—Crib Wall (Brochure, 4 pages); date unknown.
Blaha, "Retaining Wall System Keyed to Success", *Concrete Products,* 91(2):60–61 (Feb. 1988).
Block Systems Incorporated—"Beautify Your Landscape" (Advertisement, 1 page); date unknown.
Bowen Building Block & Supply Co.—price sheet and diagram (2 pages); date unknown.
Brik Block Industries—Color Crib Wall (Brochure, 4 pages); date unknown.
Cavitex Concrete Masonry Lltd.—CONCRIB™ (Brochure, 2 pages); date unknown.
Columbia Machine, Inc.—Retaining Wall Block (Brochure, 2 pages); date unknown.
Columbia Machine, Inc.—Slope and Road Paving Block (Brochure, 14 pages); date unknown.
"Cribwalling—Techniques and Design Considerations", *N.Z. Portland Cement Association* (Article, 12 pages); Apr. 1970.
DURA–HOLD® Interlocking Retaining Wall System for Heavy Duty Protection (Brochure, 2 pages); date unknown.
Federal Court of Australia, Exhibit "CFM–4"—sketch (2 pages); Oct. 8, 1996.
Federal Court of Australia, Exhibit "CFM–7"—sketch (2 pages); Oct. 8, 1996.
Federal Court of Australia, Exhibit "D"—"Advanced Concrete Technology Features New Design!" (2 pages); Oct. 14, 1996.
Figs. 15.3 and 15.4 from *Australian Concrete Technology,* p. 296 (1 page); date unknown.
Flittie/Marshall Concrete Products, Inc.—Stonescape™ Retaining Wall System (2 pages); date unknown.
Gehring, "Erosion control system produced on a block machine" (Article, 3 pages); date unknown.
Heinzmann Kunststeinwerke—Barrier Wall (Brochure, 5 pages); date unknown.
Heinzmann Kunststseinwerke—Embankment Brick System (Brochure, 3 pages); date unknown.
Humes Limited—Precast Concrete (Brochure, 20 pages); date unknown.
Jatal Industries, Inc.—Earthstone™ Retaining Wall Stores (Brochure, 2 pages); date unknown.
"Jewell Concrete Products, Inc. Expands to New Markets" *Besser Block,* Fall 1988, 13:(3).
Jumbo Nursery Stone™ Hard Working Retaining Walls (2 pages); date unknown.
Keystone® Retaining Wall Systems, Inc.—Heritage Stone Straight (Brochure, 2 pages); date unknown.
Kronimus Betonsteinwerke—Flora Kron System (Brochure, 4 pages); date unknown.
Monior Masonry—PERMACRIB Supports the Earth (Brochure, 10 pages); date unknown.
Nanazashvily, I.K., "Stroitelnye materialy is drevesho–cementnoy kompozitsii", p. 335 (1990). (showing illustration of reed–concrete block in cross–section).
PISA II® Interlocking Retaining Wall System for Garden Landscaping ((Brochure, 2 pages); date unknown.
"Product News", from *Landscape Architecture,* Aug. 1989 (3 pages).
Risi Stone Ltd.—DURA–CRIB® Interlocking Retaining Wall System (Brochure, 4 pages); date illegible.
Rockwood Retaining Walls, Inc.—EZ Wall Systems (Brochure, 2 pages); date unknown.
Rockwood Retaining Walls, Inc.—Rockwood Classic Retaining Wall System—"Shaping the world around us" (4 pages); date unknown.
Rocla—LO–Crib (Brochure, 4 pages); date unknown.
Rocla Concrete Pipes Limited—Pinned Cribbing (Brochure, 12 pages); Jun. 1971.
Rocla Masonry—Unibank Creative Embankment—Inspired by Nature (Brochure, 6 pages); May 1995.
SF Kooeration (Corporate report, 14 pages); date unknown.
SF Kooperation GmbH ESKOO®–Kleine Kruezwand (Brochure, 2 pages); date unknown.
SF–Vollverbundstein–Kooperation GmbH (Corporate report, 13 pages); date unknown.
"Straβenbau Heute—Vorgefertigte Beton–Bauteile" (2 pages); date unknown.
Tubag Trass–, Zement und Steinwerke GmbH—TUBAWALL® (Brochure, 6 pages); date unknown.
Uni—Uni–Multiwall (Brochure, 2 pages); date unknown.
Westblock Products, Inc.—69¢ 9"X4"X12" Landscape Blocks (Ad, 1 page); date unknown.
Winstone—Soil Stabilisation and Erosion Control Systems (Brochure, 9 pages); date unknown.

SPLITTING TECHNIQUE

"This is a continuation-in-part of co-pending application Ser. No. 08/774,247, filed on Nov. 8, 1996."

BACKGROUND

The process of splitting away a portion of a concrete masonry unit to provide a decorative "rockface" to the finished unit is well-known. In the case where the finished rockface is planar, it has not been uncommon to provide a linear splitting groove or pattern on the uppermost surface of the pre-split unit to aid in the splitting process.

Anchor Wall Systems, Inc. ("AWS"), my assignee, forms a faceted or "three-way" split face on some of its concrete retaining wall units. The process first requires that a pre-split concrete masonry unit be formed by a block machine. The pre-split unit must be larger than the finished unit, so that a portion of it can be split away to form the decorative face. If the block machine is large enough, the pre-split unit comprises what will ultimately be two retaining wall blocks, joined face-to-face. Otherwise, the pre-split unit comprises the finished unit with a sacrificial portion joined to its face. Some of the AWS retaining wall units, such as the ANCHOR WINDSOR STONE®, ANCHOR DIAMOND®, and DIAMOND PRO™, are formed with lips to facilitate the locating of the blocks in a wall. Since the block machine forms the units on flat, horizontal metal pallets, the pre-split units are cast with the lips facing up.

After a pre-split unit is formed in the block machine, it is hardened by any one of a variety of curing techniques, until it has attained a suitable hardness for splitting. It is then split in a splitting machine. The unit is carried into the splitting station on a roller conveyor. It is supported there by a divided receiving plate. The splitting is typically accomplished with a top knife, which is driven down onto the pre-split unit, in combination with an opposed bottom knife and opposed side knives.

In the case of the three-way split, the top and bottom knives are formed in the shape of a "crow's foot", comprising a straight center section joining two diverging V-shaped portions. Up until now, AWS has molded vertical splitting grooves, which define the rearward edges of the return facets on the finished units, into the sides of the pre-split units. The side knives engage these grooves during the splitting process.

Heretofore, AWS has not formed any type of splitting groove or pattern into the top surface of a pre-split unit which is to be split to form faceted faces on the finished units, and, in particular, has not formed any such patterns by the compressive action of a stripper shoe plate carrying appropriate tooling.

I have noted several shortcomings of the current system. It is difficult to create a face with an extended straight section and relatively short returns, particularly on the taller products. For example, AWS'current ANCHOR WINDSOR STONE® product is a four inch high block, twelve inches wide. The center section of the face is eight inches wide and the return sections are each two inches wide in front projection. AWS'current ANCHOR DIAMOND® product is a six inch high block. The center section of the face is eight inches wide and the return sections are each four inches wide in front projection. AWS has not experienced unusual difficulty in splitting these faces to the stated proportions if side knives are employed in combination with a top knife. However, AWS would like to increase the length of the center section of the ANCHOR DIAMOND® block to twelve inches, with approximately two inch returns (front projections). AWS has experienced difficulty in consistently splitting off such small wedges from the six inch tall product with standard automated splitting equipment. If the return splits are not acceptable, then the blocks must be manually dressed to make them acceptable, which increases the labor costs.

AWS would also like to minimize the need to use side knives, especially during the splitting of the ANCHOR WINDSOR STONE® product. This is because elimination of the side knives would permit the manufacturer to position two pre-split units in the splitter side-by-side, and thus create four split units with one stroke of the splitter.

Another problem is that as the block gets taller, it gets more difficult to get good return splits, regardless of how long the wedge is. For example, AWS'DIAMOND PRO™ blocks are eight inch tall products. The center section of the face of each is twelve inches wide, and the returns are three inches wide in front projection. It is difficult to consistently split the three inch wide returns on these products using conventional equipment and techniques.

SUMMARY OF THE INVENTION

I have found that I can improve the three-way splitting of our retaining wall products if I form a splitter guide pattern in the top surface of the pre-split concrete masonry unit. The guide pattern comprises a splitting groove which corresponds in length and orientation with the intended plane of the center section(s) of the face(s) of the finished unit(s), and recessed regions generally corresponding in size and orientation with the top plan of the wedges of material that need to be split from the pre-split units to create the return sections of the face(s) of the finished unit(s).

In the case of a pre-split unit comprising two identical finished units joined face-to-face, the splitting groove is formed transversely of the longitudinal axis of the unit, and along an axis of symmetry of the top surface of the pre-split unit. The splitting groove intersects recessed areas at each side edge of the top surface of the pre-split unit.

The splitting pattern is formed in the pre-split unit by the compressive action of the stripper shoe plate during the molding action of the block machine. Appropriate raised surfaces are formed on the plate to form the pattern.

DETAILED DESCRIPTION

The pre-split concrete masonry units are preferably formed in a conventional block machine, such as the V3/12 and DYNAPAC model machines, produced by Besser Co. of Alpena, Mich., and then are cured. The ANCHOR WINDSOR STONE® pre-split units may be formed generally as described in U.S. Pat. No. 5,249,950, which is incorporated herein by reference. The ANCHOR DIAMOND® and DIAMOND PRO™ pre-split units may be formed generally as described in U.S. Pat. No. 5,062,610, which is incorporated herein by reference.

Figure 1:
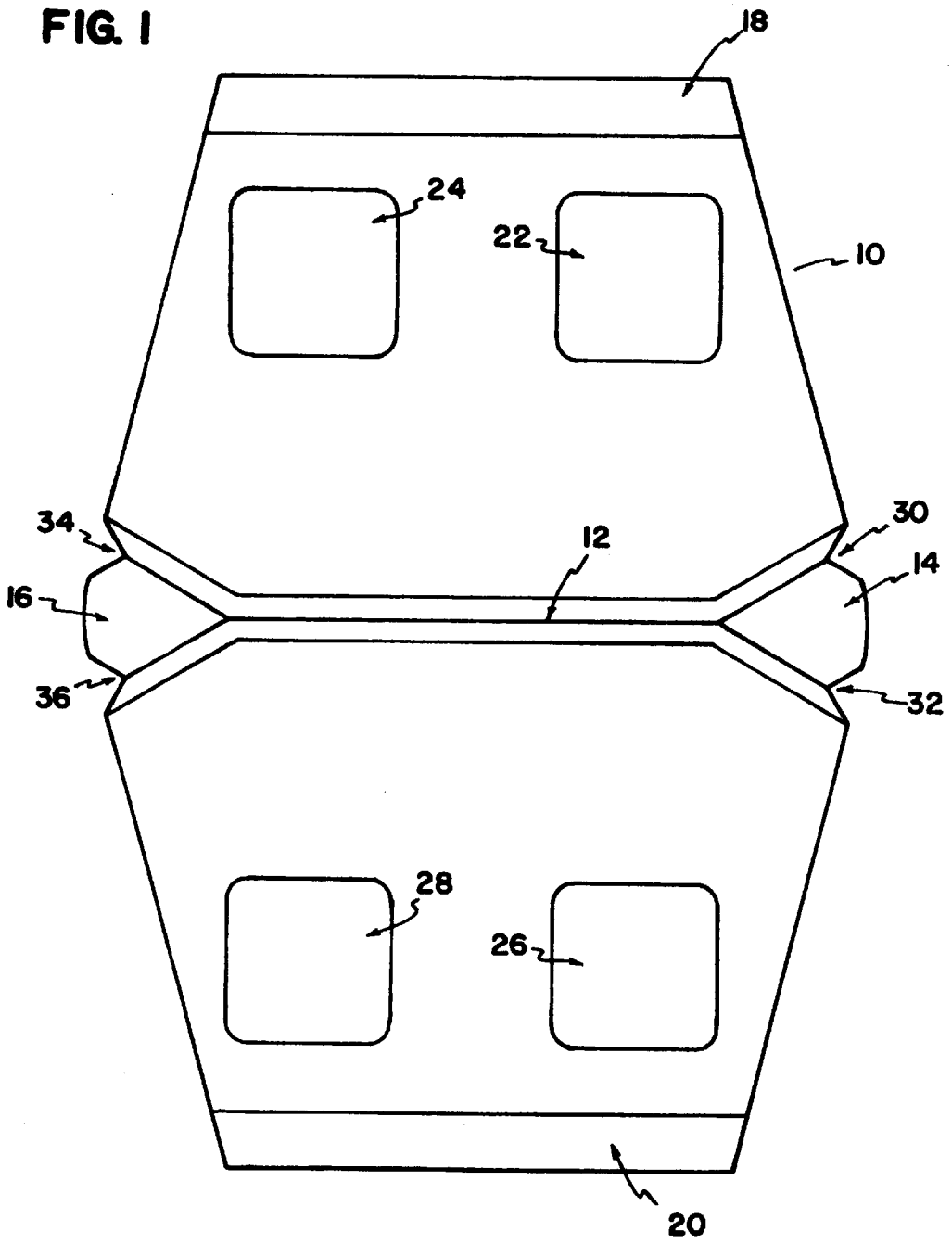
FIG. 1 is a plan view of the top, or "lips-up", side of a pre-split concrete masonry unit, (CMU), according to one aspect of my invention.

The process as described in the aforesaid patents is modified by forming a splitting pattern on the top, or "lips-up", surface of the pre-split concrete masonry unit ("CMU"). A CMU according to my invention is shown at reference numeral 10 in FIG. 1. As shown in FIG. 1, the splitting pattern comprises a transverse splitting groove 12, which intersects the two triangular-shaped recessed regions 14 and 16. The pattern is formed in the pre-split unit by the compressive action of the stripper shoe plate on the compacted mix held in the mold box. Appropriate raised surfaces are affixed to the face of the stripper shoe plate to accomplish this compressive, pattern forming action. Preferably, the depth of the splitting pattern on the pre-split unit is between ¼ inch and 1 inch, and more preferably is between ¼ inch and ½ inch. Other features of the CMU 10 are a pair of lips 18 and 20 integrally formed at the opposite ends of the top surface of the CMU, cores 22, 24, 26, and 28, and side grooves 30, 32, 34, and 36.

In the preferred embodiment, splitting grooves 12, 30, 32, 34, and 36 are V-shaped grooves, with side walls each oriented at about forty-five degrees from the horizontal, so that they intersect at an angle of about ninety degrees. In the regions of the recessed areas 14 and 16, where the splitting groove diverges, the side walls of the groove continue the same angular orientation, to provide clearance for the splitter blade, which is preferably formed with a sixty degree working edge.

The splitting may be accomplished in a splitting machine, such as those available from the Lithibar Matik company of Holland, Mich. I prefer to cure the pre-split CMU to a compressive strength of about between about 800 and 1750 psi, and more preferably, between about 1000–1200 psi. I adjust the splitting pressure in accordance with the standard skill in the art. I also prefer to use side knives and a bottom knife. In the case of the CMU 10, I prefer to have side knives contact the unit at the four side grooves 30, 32, 34, and 36, just prior to the stroke of the top knife and the bottom knife, which is a mirror image of the top knife. The bottom knife intersects the bottom surface of the CMU in planes corresponding to those intersected on the top surface by the top knife.

I have found that the technique works with symmetric pre-split units which will create two essentially identical finished units. This type of pre-split unit is shown in FIG. 1.

I have also found that the technique works with symmetric pre-split units which will create four essentially identical finished units. This type of pre-split unit is shown at reference numeral 100 in FIG. 2. Unit 100 is essentially two of the units 10 attached side-by-side by means of web 110 (without cores). Web 110 is preferably formed of the same composite fill material used to form the remainder of the CMU, and is formed during the molding process. The top, or "lips-up", surface of the web is recessed in the same manner as previously described with respect to the triangular-shaped recesses 14 and 16 shown in FIG. 1, shown as 114 and 116 in FIG. 2. Again block lips are seen at 118 and 120. When CMU 100 is aligned in the splitter, with appropriate splitter blades, it will yield four finished units with each stroke of the splitter.

When splitting CMU 100, it is preferred to use top and bottom knives as previously described, and opposed side knives at the outside grooves 130, 132, 134, and 136. No side knives are used at the inside grooves 138, 140, 142, and 144. I have found that recessing the top surface of the attaching web 110 produces a good quality split on these inside edges without the necessity of side knives, which requires minimal, if any hand dressing.

Figure 4:
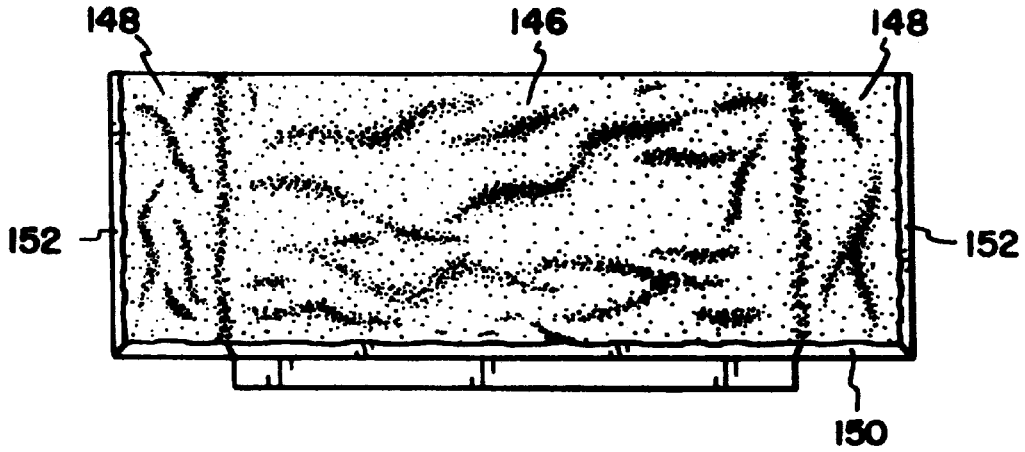
FIG. 4 is a front elevation of a finished retaining wall block made using my invention.
Figure 5:
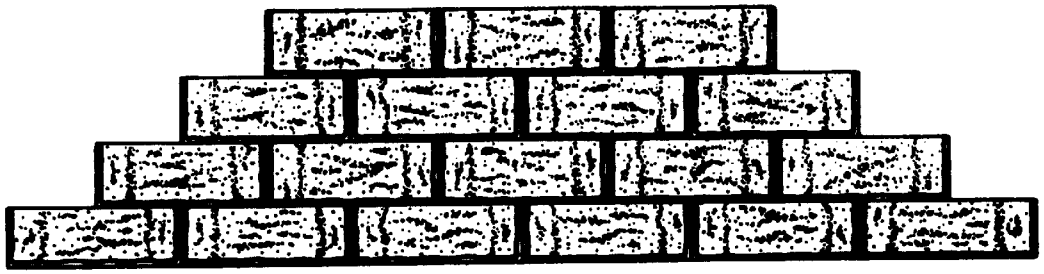
FIG. 5 is a front elevation of a retaining wall using a block made using my invention.

By using this splitting pattern technique, I have found that I can consistently produce four of our ANCHOR WINDSOR STONE® units with one stroke of the splitter. The finished units have a face height of about four inches and a face width of about twelve inches. The center section 146 of the face is about eight inches in width, and the projected width of each return section 148 is about two inches, FIG. 4. The splitting action creates broken surfaces on the center and return faces of the block, except in the chamfer regions 150, 152 along the lower and side edges of the front face. This chamfer 150 is formed by the remnant of the splitting pattern. When this block is oriented as it would be when layed up in a wall, the wall has the appearance shown in FIG. 5.

I know of no reason why the technique will not work with asymmetric pre-split units which are designed to produce one long unit and one short unit with essentially identical faces, or with an asymmetric pre-split unit, which is designed to produce one finished unit, and a sacrificial piece.

Figure 6:
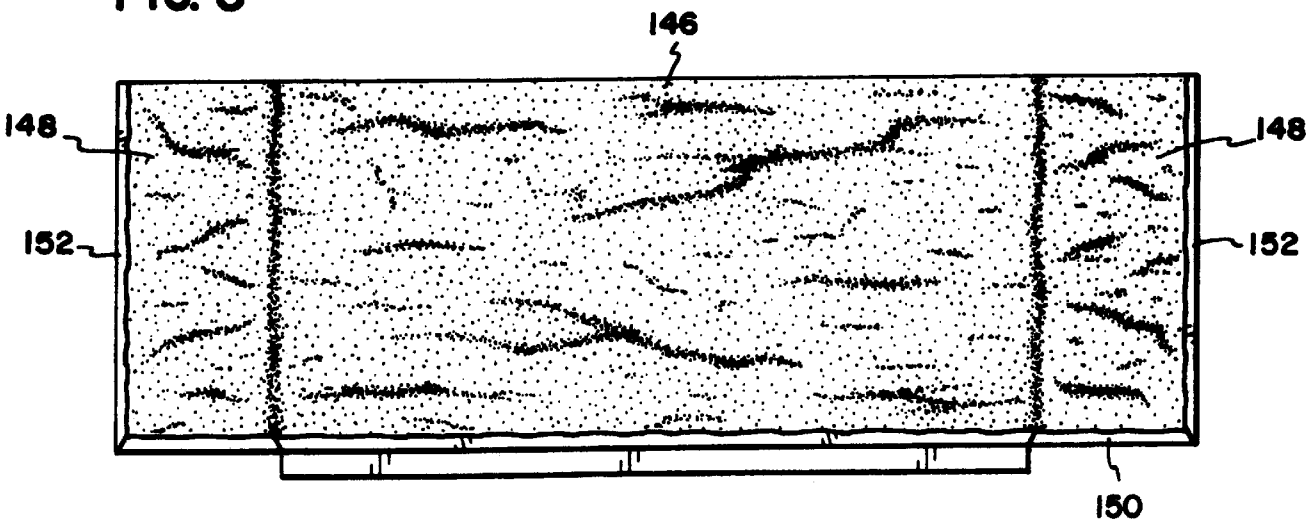
FIG. 6 is a front elevation of a Diamond® block made using my invention.

By using this splitting pattern technique, I have found that I can consistently produce two of our ANCHOR DIAMOND® units (six inches tall), having an extended center section 146 of twelve inches and returns 148 having a projected width of about two inches each, with minimal hand dressing of the units needed. The finished unit is shown in FIG. 6.

Figure 7:
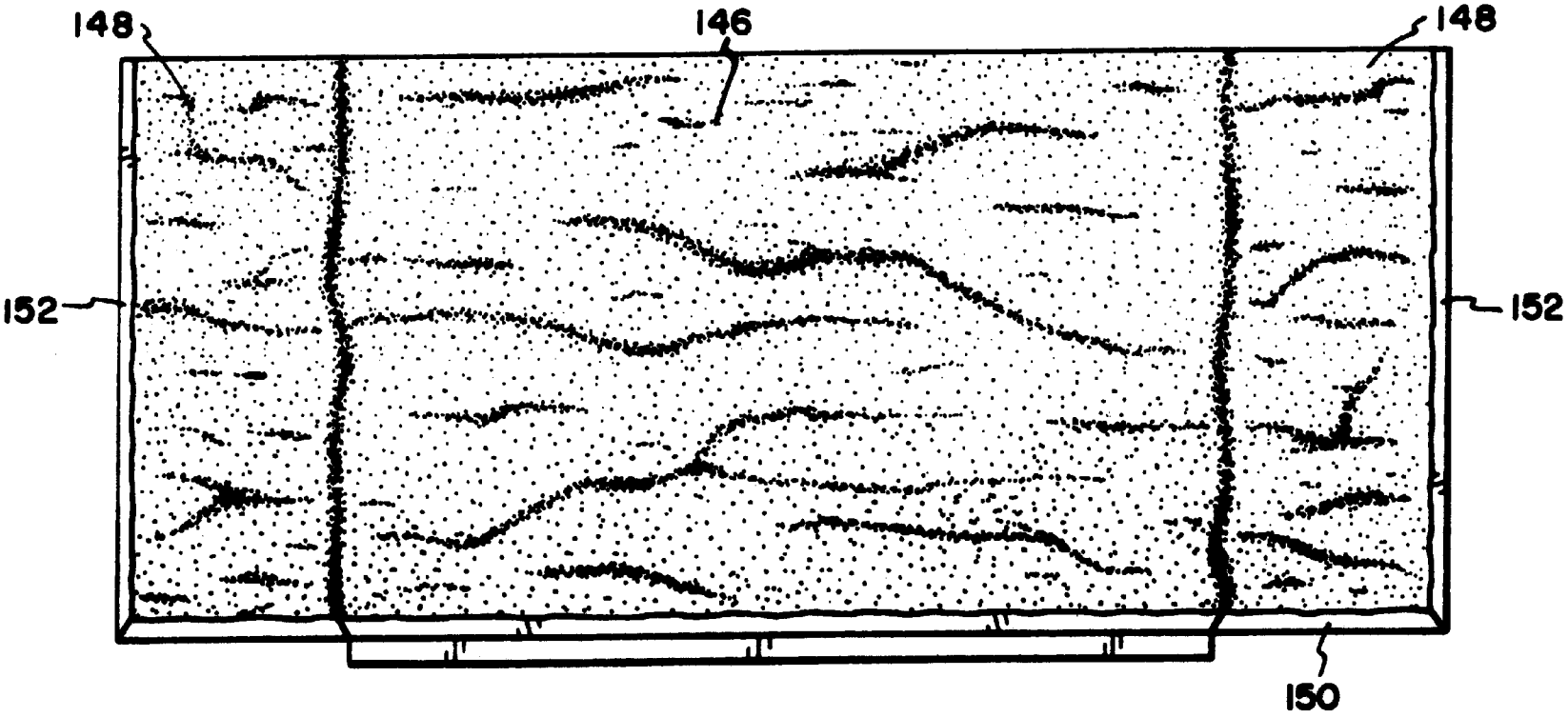
FIG. 7 is a front elevation of a Diamond Pro® block made using my invention.

By using this splitting pattern technique, I believe that I can consistently produce two of our DIAMOND PRO™ /units (eight inches tall), having an extended center section 146 of twelve inches and returns 148 having a projected width of about three inches each, with minimal hand dressing of the units needed. The finished unit is shown in FIG. 7.

Figure 2:
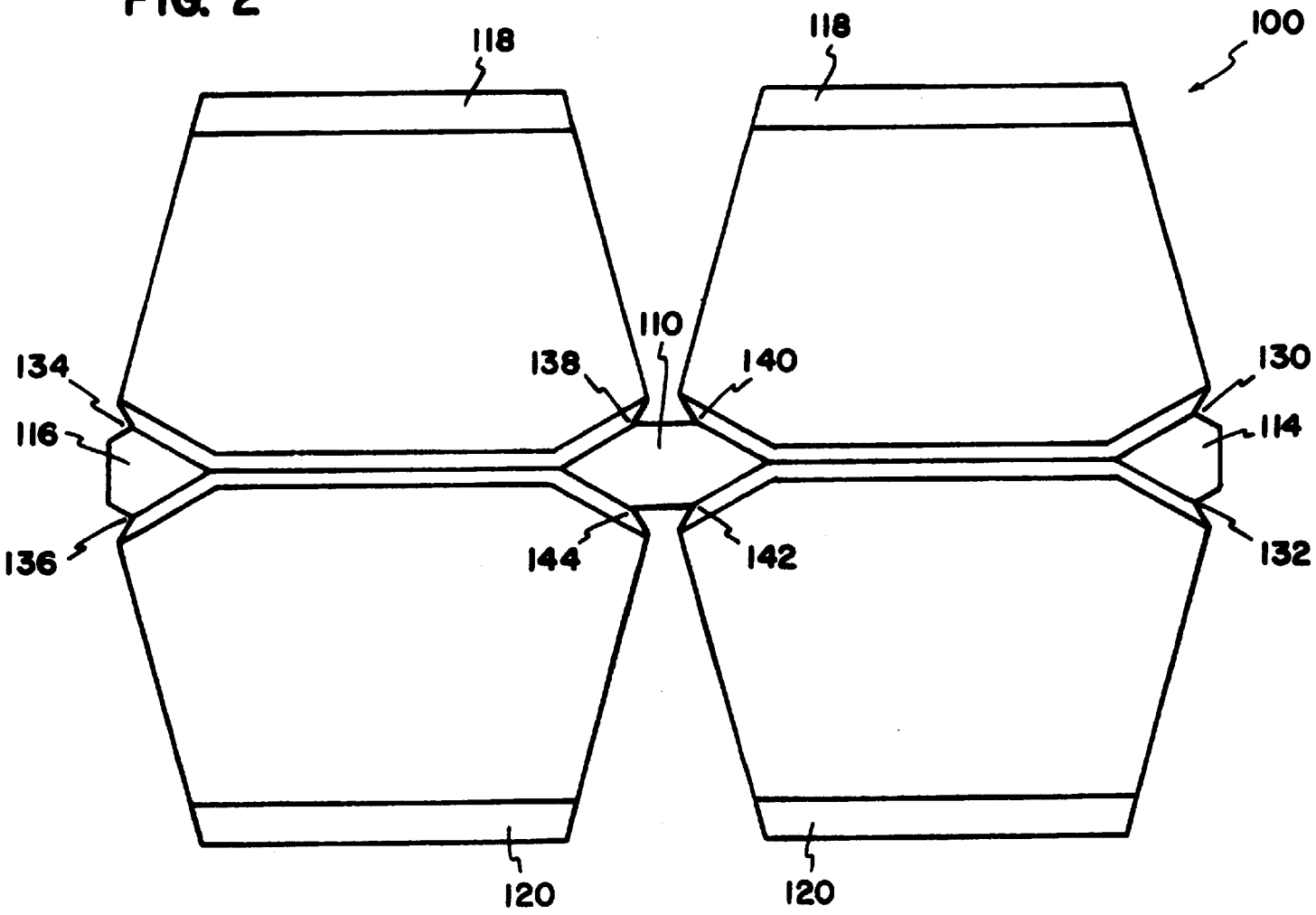
FIG. 2 is a plan view of the top, or "lips-up", side of a pre-split concrete masonry unit according to an additional aspect of my invention.
Figure 3:
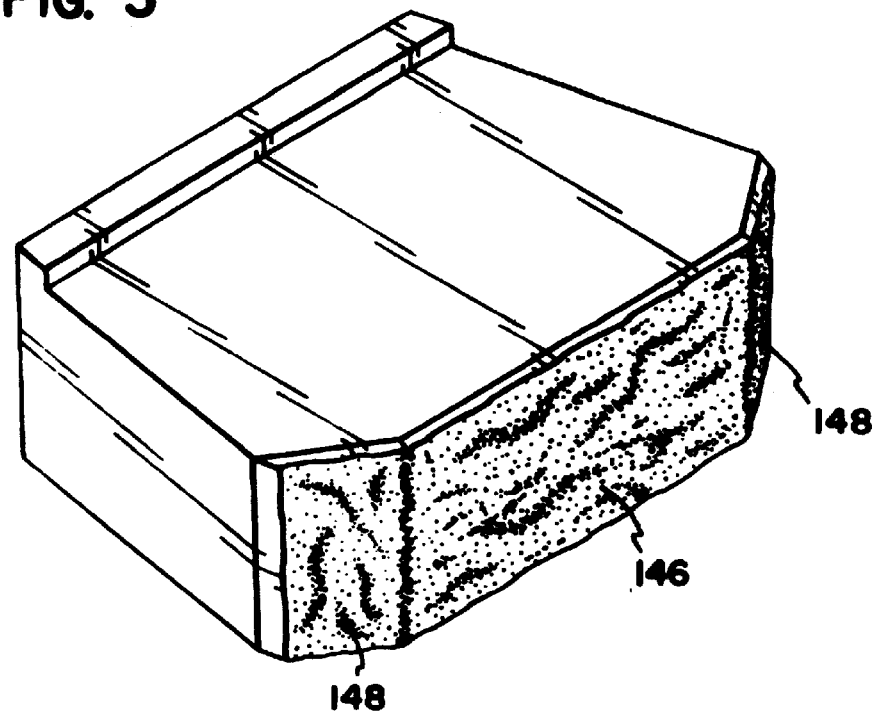
FIG. 3 is a perspective view of the "lips-up" side of a finished retaining wall block according to my invention showing the chamfer formed by the splitting pattern.
Figure 8:
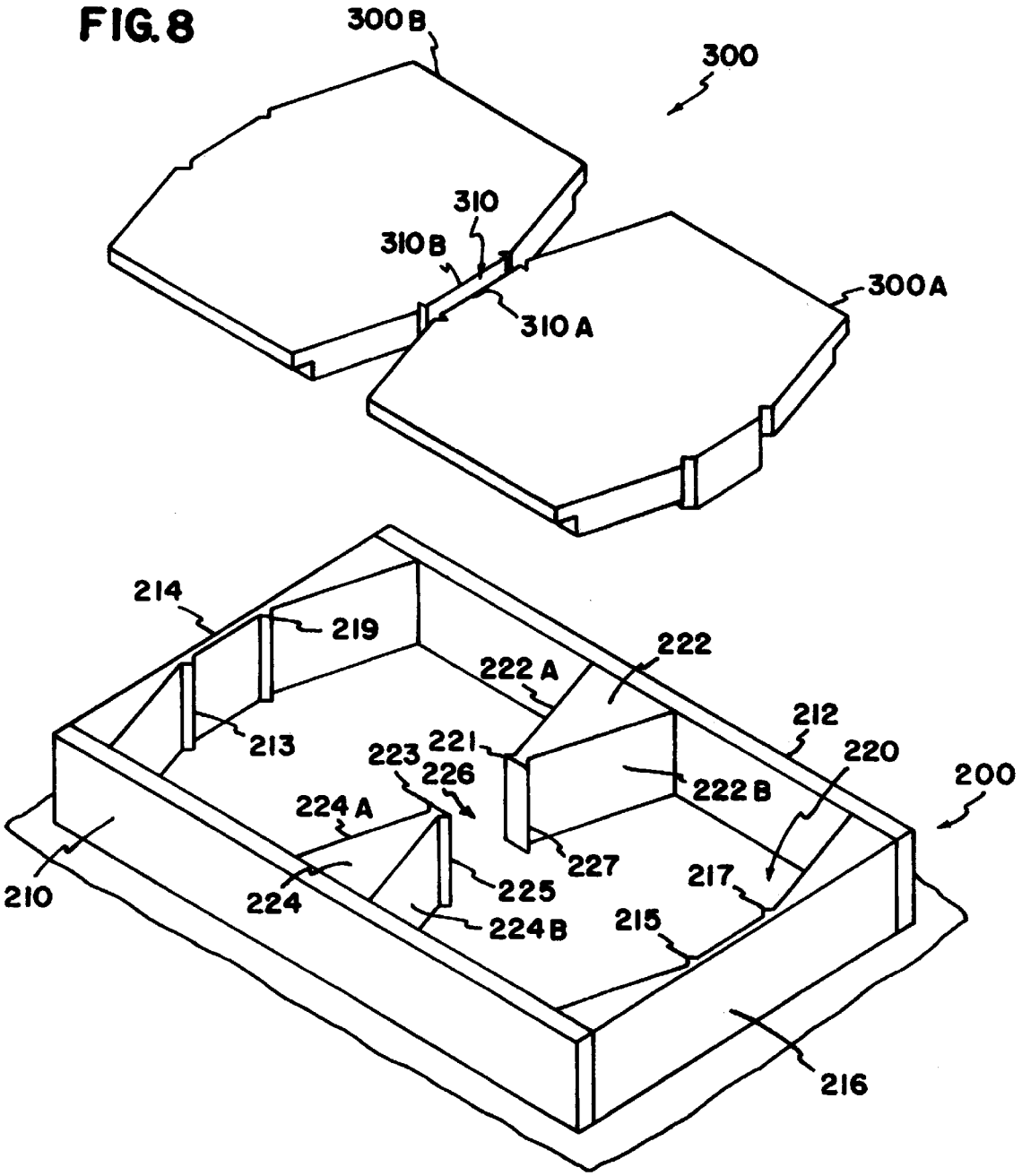
FIG. 8 is an exploded perspective view of a mold assembly in accordance with my invention.

The mold or mold box 200 may be configured to produce a single CMU, see FIG. 1, or a pair of CMU's, see FIG. 2, which are centrally joined until split. The mold shown in FIG. 8 may be used for the production of CMU's. The mold 200 generally comprises at least four sides defining a central cavity 220. As can be seen in FIG. 8, the mold generally has a front wall 210, a back wall 212, and first 216 and second 214 opposing sides or end plates. The central cavity 220 is bordered by these walls.

The mold functions to facilitate the formation of the blocks. Accordingly, the mold may comprise any material which will withstand the pressure to be applied to block fill by the head. Preferably, metals such as steel alloys having a Rockwell "C"-scale ranging from about 60–65 provide optimal wear resistance and the preferred rigidity. Generally, metals found useful in the manufacture of the mold of the present invention include high grade carbon steel 41–40 AISI (high nickel content, prehardened steel), carbon steel 40–50 (having added nickel) and the like. A preferred material includes carbon steel having a structural ASTM of A36.

The mold of the invention may be made by any number of means known to those of skill in the art. Generally, the mold is produced by cutting the stock steel, patterning the cut steel, providing an initial weld to the patterned mold pieces and heat treating the mold. Heat treating generally may take place at temperatures ranging from 1000° F. to 1400° F. for 4 to 10 hours depending on the ability of the steel to withstand processing and not distort. After heat treating, final welds are then applied to the pieces of the mold.

The mold walls generally function according to their form by withstanding the pressure created by the stripper shoe assembly. Additionally, the mold walls function to ensure that uniform pressure is applied throughout the entire block during formation. Further, the walls generally guide the height, width and depth of the resulting blocks. Accordingly the mold walls must be made of a thickness which will accommodate the processing parameters of block formation given a specific mold composition. Preferably, the mold walls range in thickness from about 0.25 inch to about 2.0 inches, preferably from about 0.75 inch to 1.5 inches.

During the molding of a double CMU piece, FIG. 8, the fill may be separated by division plates such as first 222 and second 224 partition members between which extends an opening 226. The sidewalls 222A and 222B of the first partition 222 and the sidewalls 224A and 224B form the respective sides of the two CMU seen in FIG. 2. Within opening 226 the web 110 (FIG. 2) forms connecting one CMU to the other.

Preferably, the mold 200 further comprises splitting ridges. Once the block is molded, and preferably cured, the splitting ridges assist during the splitting process in creating splits which define the individual blocks. As can be seen in FIG. 8, one embodiment of my invention shows first 215 and second 217 splitting ridges on the first side 216 of the mold. The second side 214 of the mold preferably also has a first 213 and second 219 splitting ridges. The splitting ridges may span from the mold bottom surface to the mold top surface. If the mold is used to form a double CMU, first 222 and second 224 partitions also preferably have splitting ridges which span from the mold bottom surface to the mold top surface. Here again, the first partition 222 splitting ridges 221 and 227 are preferably positioned opposite respective splitting ridges 219 and 217 on the first and second sides. The second partition 224 splitting ridges 223 and 225 preferably have a similar orientation to respective ridges 213 and 215.

The stripper shoe plate assembly 300 generally functions with the mold 200 in forming the masonry units of the invention. In order to form two CMU's which are joined by a central web 110, the two stripper shoe plates 300A and 300B preferably each have a centered edges 310A and 310B which lie adjacent each other in a configuration 310 which complements opening 226 lying between first 222 and second 224 partitions in the mold 200.

Figure 9:
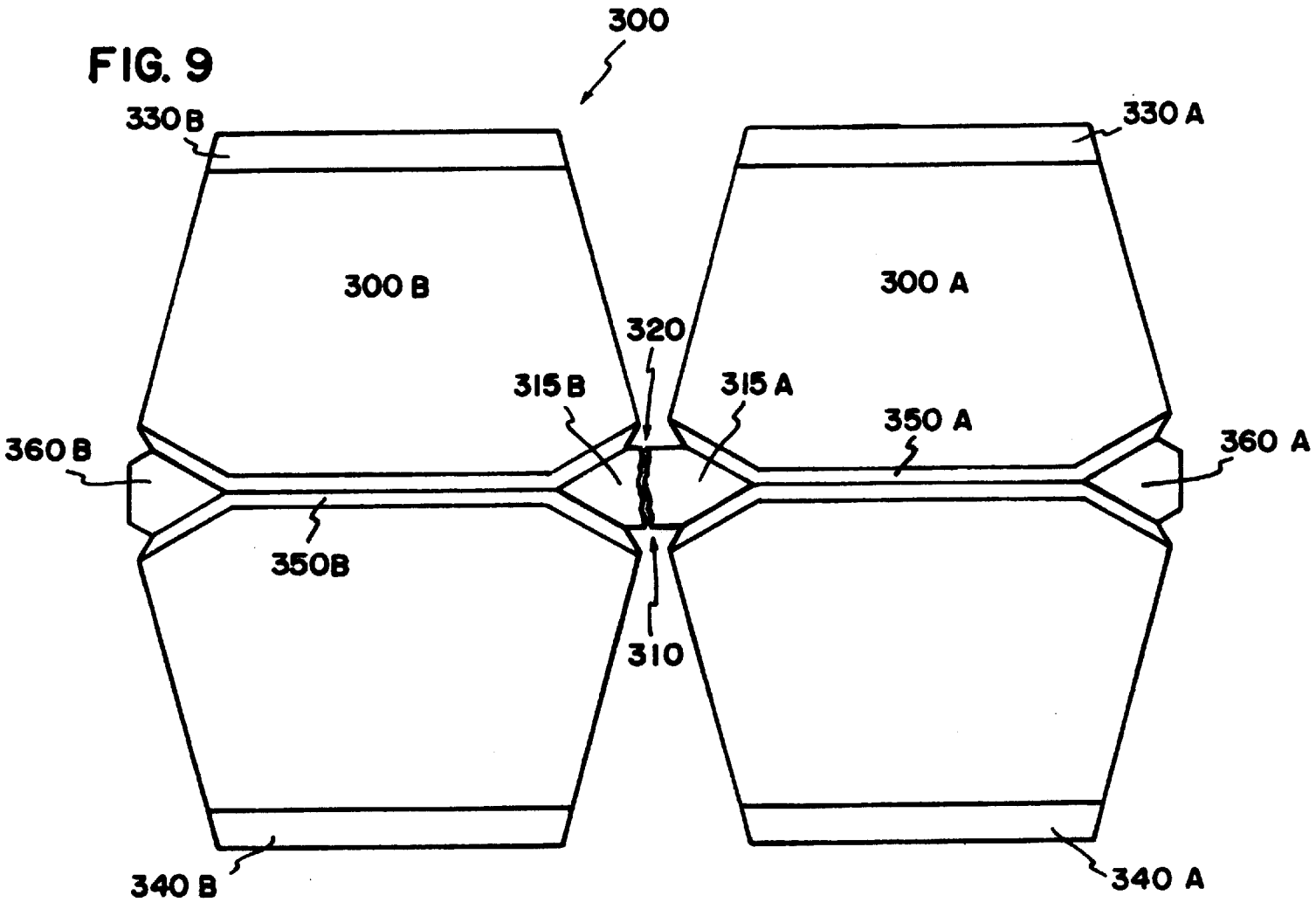
FIG. 9 is a bottom plan view of one embodiment of a stripper shoe plate according to one aspect of my invention.

One embodiment of a stripper shoe assembly 300 in accordance with my invention may be seen in FIG. 9. Stripper shoe plates 300A and 300B are not joined. Preferably, shoe plate piece 315A converges toward shoe plate piece 315B separated by a small opening 320. As can be seen, shoe piece 315A may extend farther toward shoe plate piece 315B. Alternatively, shoe pieces 315A and 315B may extend toward each other an equal distance.

Figure 10:
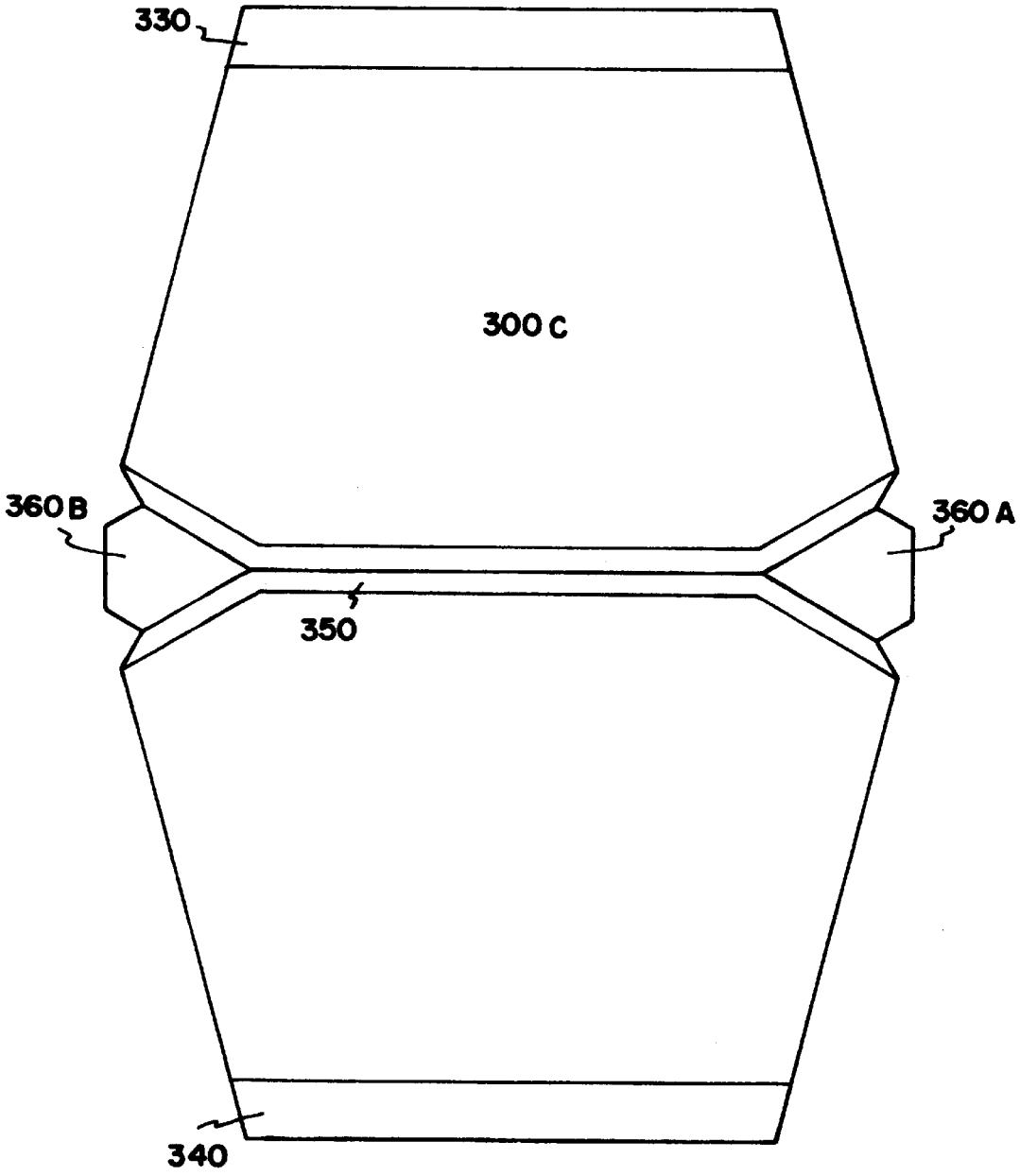
FIG. 10 is a bottom plan view of a further embodiment of a stripper shoe plate according to an alternative aspect of my invention.

Depressions 330A and 330B as well as 340A and 340B, seen in FIGS. 9 and 10, complement raised flange portions 118 and 120 of the two CMU's. Shoe plate pieces 315A and 315B complement the central web 110 portion as is seen in FIG. 2. Further, raised portions 350A and 350B complement the splitting grooves 12 (FIG. 1) and depressed regions 14 and 16 in the formed CMU.

As can be seen in FIG. 9, raised splitting regions 315A, 315B, 360A and 360B are configured at the side edges of the bottom surface of each stripper shoe plate 300A and 300B. Splitting regions may be triangular in shape. The raised surface also may comprise a splitting ridge 350A and 350B. The splitting ridge may define an axis of symmetry for each of the splitting regions and may also define an approximate axis of symmetry of the bottom surface of the stripper shoe 300A or 300B.

FIG. 10 illustrates a stripper shoe plate 300C which may be used to make a single CMU with a mold similar to that seen in FIG. 8. Again, the same portions of the stripper shoe complement those elements formed in the single CMU shown in FIG. 1.

I have found, by using this technique, that I can achieve a more subtle, aesthetically-pleasing look on our taller blocks, (DIAMOND and DIAMOND PRO™) due to our ability to make the shorter return facets. I have also found that the unbroken remnant of the splitting pattern which remains on the finished faces creates a pleasing chamfer on the lower and side edges of the finished faceted face. I have found that this chamfer, in combination with the shorter returns and the course-to-course setback when the blocks are formed into a wall, creates a unique look that has not heretofore been achieved in faceted retaining walls.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A mold for making a pre-split concrete masonry unit adapted to be split in a masonry block splitting machine to yield more than two decorative units by means of a single cycle of the splitting machine, said mold comprising a front, a back, and first and second opposed sides defining a cavity, said first side comprising at least one splitting ridge, said second side comprising at least one splitting ridge, said first side splitting ridge positioned opposite said second side splitting ridge, a first partition affixed to said mold front extending into said mold cavity and a second partition affixed to said mold back, said first partition positioned opposite said second partition.

2. The mold of claim 1, wherein said mold comprises a top surface and a bottom surface and each of said first and second side splitting ridges extend from said mold top surface to said mold bottom surface.

3. The mold of claim 1, wherein said first and second partitions define an opening between said first and second partitions.

4. The mold of claim 1, wherein said mold first side comprises first and second splitting ridges and said mold second side comprises first and second splitting ridges, said mold first side first and second splitting ridges positioned opposite said mold second side first and second splitting ridges, respectively.

5. The mold of claim 4, wherein said mold comprises a top surface and a bottom surface, and said first partition comprises first and second splitting ridges spanning from said mold top surface to said mold bottom surface, and said second partition comprises first and second splitting ridges spanning from said mold top surface to said mold bottom surface.

6. The mold of claim 5, wherein said first partition first splitting ridge is positioned opposite said first side first splitting ridge and said first partition second splitting ridge is positioned opposite said second side first splitting ridge.

7. The mold of claim 6, wherein said second partition first splitting ridge is positioned opposite said first side second splitting ridge and said second partition second splitting ridge is positioned opposite said second side second splitting ridge.

8. A mold for producing a pre-split concrete masonry unit comprising at least two bodies joined in side-by-side relationship by a web of concrete, said mold comprising a first wall which is opposed to a second wall, a third wall which is opposed to a fourth wall, a first partition extending from one of said walls, and a second partition extending from the wall opposed to said one wall, said first partition positioned opposite said second partition, said first and second partitions define an opening between said first and second partitions, said first, second, third, and fourth walls and first and second partitions define first and second respective cavities, wherein said first and second cavities are substantially symmetrical about a central axis, said central axis defined by said first and second partitions, and wherein said first and second cavities are substantially symmetrical about a lateral axis, said lateral axis being perpendicular to the central axis and wherein the opposed walls from which the partitions extend are front and back walls of the mold and the opposed walls from which the partitions do not extend are first and second sides of the mold; and wherein said mold comprises a top surface and a bottom surface, wherein said mold first side comprises first and second splitting ridges spanning from said mold top surface to said mold bottom surface, and said mold second side comprises first and second splitting ridges spanning from said mold top surface to said mold bottom surface, said mold first side first and second splitting ridges are positioned opposite said mold second side first and second splitting ridges, respectively.

9. The mold of claim 8, wherein said first partition comprises first and second splitting ridges spanning from said mold top surface to said mold bottom surface, and said second partition comprises first and second splitting ridges spanning from said mold top surface to said mold bottom surface.

10. The mold of claim 9, wherein said first partition first splitting ridge is positioned opposite said first side first splitting ridge and said first partition second splitting ridge is positioned opposite said second side first splitting ridge, said second partition first splitting ridge is positioned opposite said first side second splitting ridge and said second partition second splitting ridge is positioned opposite said second side second splitting ridge.

* * * * *

UNITED STATES PATENT AND TRADEMARK OFFICE

CERTIFICATE OF CORRECTION

PATENT NO. : 6,029,943

DATED : FEBRUARY 29, 2000

INVENTOR(S) : SIEVERT

It is certified that error appears in the above-identified patent and that said Letters Patent is hereby corrected as shown below:

Col. 2, line 16: "AWS'DIAMOND PRO™" should read --AWS' DIAMOND PRO™--

Col. 3, line 47: "company" should read --Company--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*